US005998921A

United States Patent [19]

Nakaya et al.

[11] Patent Number: 5,998,921

[45] Date of Patent: Dec. 7, 1999

[54] FLUORESCENT LAMP WITH COIL SHAPED INTERNAL ELECTRODE

[75] Inventors: Tomio Nakaya, Kanagawa -ken; Toshiyuki Terada, Tokyo; Mitsunari Yoshida; Tomonori Abe, both of Kanagawa-ken, all of Japan

[73] Assignee: Stanley Electric Co., Ltd., Tokyo, Japan

[21] Appl. No.: 08/928,857

[22] Filed: Sep. 12, 1997

[30] Foreign Application Priority Data

Mar. 21, 1997 [JP] Japan ..... 9-068009
Jul. 4, 1997 [JP] Japan ..... 9-179734

[51] Int. Cl.[6] ..... H01J 1/30; H01J 1/88; H01J 19/24; H01J 19/42

[52] U.S. Cl. ..... 313/491; 313/488; 313/607; 313/234

[58] Field of Search ..... 313/485, 488, 313/491, 607, 234, 269, 574, 628, 634

[56] References Cited

U.S. PATENT DOCUMENTS 5,013,959 5/1991 Kogelschatz ..... 313/607
5,604,410 2/1997 Vollkommer et al. ..... 313/607

FOREIGN PATENT DOCUMENTS 7272694 10/1995 Japan ..... H01J 65/04

*Primary Examiner*—Michael Day
*Attorney, Agent, or Firm*—Weingarten, Schurgin, Gagnebin & Hayes LLP

[57] ABSTRACT

A fluorescent lamp includes a tubular glass bulb, an internal electrode provided substantially along the central axis of the tubular glass bulb, a fluorescent layer provided on the inner surface of the tubular glass bulb, and an external electrode provided on the outer surface of the tubular glass bulb, wherein the internal electrode, having a coiled shape, is laid in the tubular glass bulb with an appropriate tension. According to the present invention, it is possible to prevent a sag in the internal electrode from occurring due to a difference in coefficient of thermal expansion between the tubular glass bulb and a metallic member forming the internal electrode, and to prevent either the tubular glass bulb or the internal electrode from being broken because of an excessive stress, thereby overcoming the problem concerning such type of fluorescent lamp.

20 Claims, 6 Drawing Sheets

FLUORESCENT LAMP WITH COIL SHAPED INTERNAL ELECTRODE

BACKGROUND OF THE INVENTION

1. Field of the Invention

The present invention relates to a fluorescent lamp and a method for manufacturing the same, more particularly to a fluorescent lamp and a method for manufacturing the same, which is constructed such that an electric discharge is performed through a tubular glass bulb or a dielectric between an internal electrode axially passing through the tubular glass bulb forming a discharge chamber and an external electrode provided on an outer surface of the tubular glass bulb.

2. Background Art

An example of a prior fluorescent lamp, such a type as described above, constructed such that a discharge is performed through a dielectric between an internal electrode and an external electrode is disclosed, for example, in Japanese Patent Laid-Open Publication Hei. 7-272694.

FIG. 10 shows an example of a constitution of a prior fluorescent lamp 80 such a type as described above. A tubular glass bulb 81 applied a fluorescent layer 82 on an inner surface thereof has been discharged the air, filled with gas and then sealed at both ends, thereby forming a discharge chamber 81*a*. An external electrode 83 is formed on an outer surface of the tubular glass bulb 81.

In the discharge chamber 81*a*, an internal electrode 84 made of a metal rod or a thin and long metal tube is laid substantially along the central axis of the tubular glass bulb 81.

FIG. 11 shows another example of a constitution of a prior fluorescent lamp 85 such a type as described above. A tubular glass bulb 87 applied a fluorescent layer 82 on an inner surface thereof has been sealed by flare stems 88*a*, 88*b* at both ends, thereby forming a discharge chamber 89. In the discharge chamber 89, a getter 90 and an internal electrode 91 are provided, and rare gas (not shown) is filled. An external electrode 92, made of a conductive coating or the like, is formed on an outer surface of the tubular glass bulb 87. A light emitting is accomplished by applying high-frequency power between the internal electrode 91 and the external electrode 92.

However, there are some problems with the above-described fluorescent lamp constructed such that a discharge is performed through a dielectric, compared to a conventional fluorescent lamp, which has been employed, constructed such that a pair of electrodes face each other and a discharge is performed only in a discharge chamber.

In the above-described fluorescent lamp, it has a constitution that an internal electrode axially passing through a tubular glass bulb. Therefore, it causes a first problem that the internal electrode or the tubular glass bulb is deformed or broken because of a change in the ambient temperature, a temperature rise in discharging or the like, since the coefficient of expansion of the internal electrode made of a metal differs from that of the tubular glass bulb.

Also, the discharge is performed between almost whole of the surface of the internal electrode and the external electrode. Therefore, for example, when a part where a discharge resistance is slightly lower than another part exists in the electrodes, the discharge tends to be concentrated on the part, which in turn causes a second problem that the concentrated part in the internal electrode or the external electrode is exhausted.

In addition, the discharge is performed through a tubular glass bulb as a dielectric. Therefore, the tubular glass bulb is also exhausted. Particularly when the discharge is concentrated as described above, the concentrated part of the tubular glass bulb is holed to lose functions as the discharge chamber, which in turn causes a third problem that the whole of the fluorescent lamp is broken.

Furthermore, the fluorescent lamp of this type causes a fourth problem that it shows a tendency to be a lower efficiency compared to the above-mentioned conventional fluorescent lamp constructed such that a discharge is performed only in a discharge chamber. Accordingly, with regard to a fluorescent lamp constructed such that a discharge is performed through a dielectric, unique problems, which will be overcome by the present invention, arising from such construction occurs.

A method for manufacturing the conventional fluorescent lamp 85 shown in FIG. 11 is next described in order of process in connection with FIGS. 12A to 12D. First, as shown in FIG. 12A, a mount is formed by connecting a flare stem 88*a*, to which a getter 90 is attached, to one end of the internal electrode 91 made of, for example, a tungsten wire by spot welding or the like.

Next, as shown in FIG. 12B, the mount is inserted into the tubular glass bulb 87 in a condition that the internal electrode 91 is hung downward. The flare stem 88*a* is deeply inserted so that the other end of the internal electrode 91 appears at the bottom of the tubular glass bulb 87. The other flare stem 88*b* is attached to the other end of the internal electrode 91 by spot welding or the like. Furthermore, a fluorescent layer 86 is formed on the inner surface of the tubular glass bulb 87 in advance.

Next, as shown in FIG. 12C, the flare stem 88*a* is pulled up so that the position thereof agrees with the upper end of the tubular glass bulb 87, and the flare stem 88*a* is welded. Thereafter, as shown in FIG. 12D, the other flare stem 88*b* is positioned so that the position thereof agrees with the lower end of the tubular glass bulb 87, and the other flare stem 88*b* is welded.

However, according to this conventional manufacturing method, the flare stem 88*a* is deeply inserted into the tubular glass bulb 87 in order to attach the other flare stem 88*b*, as shown in FIG. 12B. Therefore, the flare stem 88*a* attains the fluorescent layer 86, thereby causing a problem that the circumference of the flare stem 88*a* scratches the fluorescent layer 86.

Additionally, the above manufacturing method contains steps, for example, such that the flare stem 88*a* is made to have a round trip in the tubular glass bulb 87 so as to attach the flare stem 88*b*, which is troublesome and is not always necessary for the completed fluorescent lamp 85. Therefore, the above method causes problems that it shows a low manufacturing efficiency and a low productivity, which will be overcome by the present invention.

SUMMARY OF THE INVENTION

The present invention provides a fluorescent lamp, as means for solving the above-described problems, which comprises a tubular glass bulb forming a discharge chamber, an internal electrode provided substantially along the central axis of the tubular glass bulb and passing through the tubular glass bulb, a fluorescent layer provided on an inner surface of the tubular glass bulb, and an external electrode provided on an outer surface of the tubular glass bulb, wherein the internal electrode, at least a part of which has a coiled shape, is laid in the tubular glass bulb with an appropriate tension.

The present invention also provides a method for manufacturing a fluorescent lamp, as means for solving the above-described problems, which comprises the steps of: forming a mount to which a coiled internal electrode is attached between lead-in wires of a pair of stems, at least one of the stem of the mount being a bead stem and a metal stick weight being attached to the outer end of the lead-in wire on the bead stem side so as to form a straight line with the lead-in wire on the bead stem side; allowing the mount to be hung downward such that the bead stem and the weight are at the lower side in a tubular glass bulb to which a fluorescent material is previously applied; welding the upper stem in a state that the mount is hung downward; setting the bead stem at a welding position by handling the weight such that an appropriate tension is applied to the internal electrode; and welding the bead stem in this state.

DETAILED DESCRIPTION OF THE PREFERRED EMBODIMENTS

The present invention will be now described in detail on the basis of embodiments with reference to the accompanying drawings.

Figure 1:
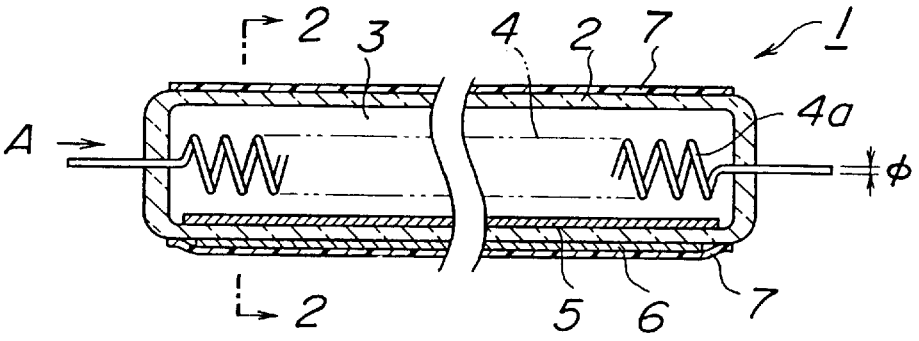
FIG. 1 is a cross section of a fluorescent lamp according to a first embodiment of the present invention.

Referring to FIG. 1, reference numeral 1 designates a fluorescent lamp according to the present invention. The fluorescent lamp 1 comprises a tubular glass bulb 2, an internal electrode 4, a fluorescent layer 5, and an external electrode 6.

The tubular glass bulb 2 is filled with gas, thereby forming a discharge chamber 3. In the discharge chamber 3, the internal electrode 4 which is substantially along the central axis of the tubular glass bulb 2 is provided or laid in the tubular glass bulb 2 such that both ends of which pass through the tubular glass bulb 2.

Figure 2:
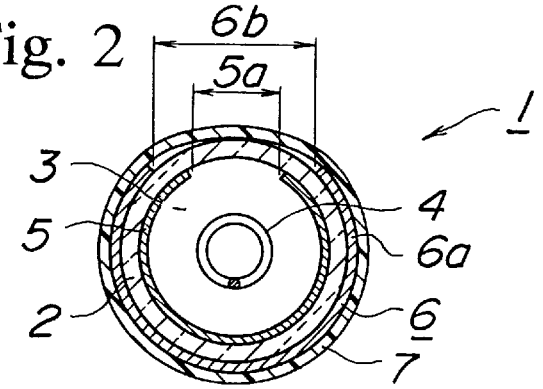
FIG. 2 is a cross section along the line X—X of FIG. 1.

The fluorescent layer 5, which is axially elongated, is formed on the inner surface of the tubular glass bulb 2. The external electrode 6, which is axially elongated, is formed on the outer surface of the tubular glass bulb 2. As shown in FIG. 2, the fluorescent layer 5 and the external electrode 6 have openings 5*a* and 6*b*, respectively.

In the present invention, the internal electrode 4 has a coiled shape with a coil part 4*a*. When the internal electrode 4 is attached to the tubular glass bulb 2, a tensile force is applied to both ends of the internal electrode 4 by appropriately expanding the coil part 4*a*. The tensile force applied to the internal electrode 4 or an amount of expansion of the internal electrode 4 can be freely set by taking coefficients of thermal expansion of the tubular glass bulb 2 and the internal electrode 4 into consideration.

Any kind of a conductive material can be utilized for the internal electrode 4 in principle. However, it is preferable to utilize a wire with a getter function such as niobium (Nb), titanium (Ti), or tantalum (Ta).

The diameter $\phi$ of the internal electrode 4 is preferably associated with the lighting current A of the fluorescent lamp 1 in the present invention. Particularly, it is preferable to set a relation of the diameter $\phi$ (unit:mm) and the lighting current A (unit:ampere) so as to satisfy a condition $\phi \leqq kA$, where k is a proportionality constant such that in the example where A is in A units and $\phi$ is in mm units, k=1. For example, when the lighting current A of the fluorescent lamp 1 is 0.3 A (300 mA), the diameter $\phi$ of the internal electrode 4 is preferably equal to or less than 0.3 mm.

The external electrode 6 is preferably a metallic foil with a bright surface 6*a* such as a mirror finished surface.

The external electrode 6 is attached to the tubular glass bulb 2 by causing a heat shrink tube 7 made of a silicon resin to be adhered on the external electrode 6. The heat shrink tube 7 is transparent so as that the emitted light should be surely irradiated therethrough.

The fluorescent layer 5 and the external electrode 6 are formed such that the opening 5*a* axially elongated along the tubular glass bulb 2 corresponds to the opening 6*b* axially elongated along the tubular glass bulb 2.

In addition, as shown in FIG. 2, it is preferable that the fluorescent layer 5 conceals both edges of the opening 6*b* provided in the external electrode 6, when the opening 5*a* provided in the fluorescent layer 5 is observed from the position of the internal electrode 4. In other words, the openings 5*a* and 6*b* are formed such that both edges of the opening 6*b* of the external electrode 6 can not be observed if they are seen from the position of the internal electrode 4.

The function and effects of the above-described fluorescent lamp 1 of the present invention is now explained. In the fluorescent lamp 1, the coil part 4*a* is formed in the internal electrode 4, which is attached to the tubular glass bulb 2 at a laid-in state with tension. Therefore, it is possible to absorb the difference in thermal expansion length because the coil part 4*a* of the internal electrode 4 attached to the tubular glass bulb 2 with relatively small coefficient of thermal expansion contracts at an amount corresponding to the length extended by the tension, even when the internal electrode 4 expands more than the increase of the length occurred in the tubular glass bulb 2.

On the contrary, even when the contracted length of the internal electrode 4 is longer than that of the tubular glass bulb 2 because of the decrease in the ambient temperature, it is possible to absorb the difference in thermal contraction length because the coil part 4*a* expands. Therefore, in both cases, it is possible to avoid such situation that a deformation such as a sag occurs in the internal electrode 4 or a break such as a crack occurs in the tubular glass bulb 2 by an excessive stress.

Figure 3:
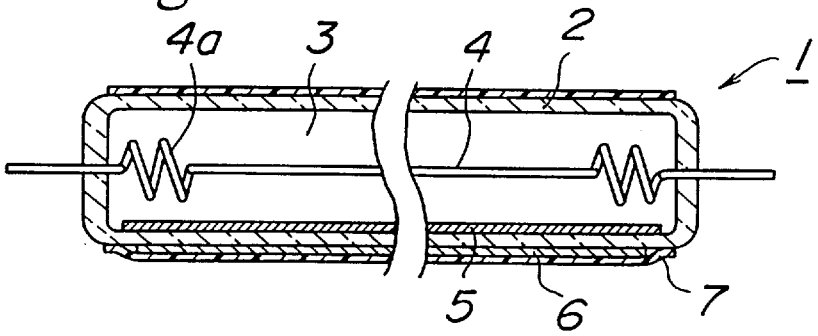
FIG. 3 is a cross section of a fluorescent lamp according to a second embodiment of the present invention.

The coiled part may be formed at a part of the internal electrode 4, for example two parts positioned at both ends of the internal electrode 4 as shown in FIG. 3, since the object is sufficiently attained if the coiled part can absorb the difference in thermal expansion or contraction length. Therefore, it is not necessary that the whole of the internal electrode 4 is coiled.

In addition, since the diameter $\phi$ of the internal electrode 4 is associated with the lighting current A to satisfy the inequality $\phi \leqq kA$, every part of the internal electrode 4 has appropriate resistance, thereby the current is not concentrated locally. Therefore, it is possible to prevent the internal electrode 4 or the external electrode 6 from being broken. Furthermore, since the wire with a getter function is used as the internal electrode 4, it is possible to simplify the constitution of the fluorescent lamp 1 by eliminating a getter, which is usually prepared as another part.

The external electrode 6, which originally acts as an electrode, also acts as a reflecting mirror to reflect light emitted from the fluorescent layer 5 toward the inner direction of the tubular glass bulb 2, because the surface 6*a* of the external electrode 6 is made of a mirror finished metallic foil. Therefore, it is possible to increase an apparent luminous efficiency of such type of fluorescent lamp 1 by increasing a quantity of light irradiated from the openings 5*a* and 6*b* to the outside.

Furthermore, it is possible to unify the discharge condition in which the fluorescent layer 5 always exists along the discharge path from the internal electrode 4 to the external electrode 6, because both edges of the opening 6*b* provided in the external electrode 6 are concealed by the fluorescent layer 5 when observed from the discharge chamber. Therefore, it is possible to avoid such situation that the discharge concentrates at a part that is not covered with the fluorescent layer 5 and the tubular glass bulb is holed to lose functions of the fluorescent lamp 1.

Figure 4:
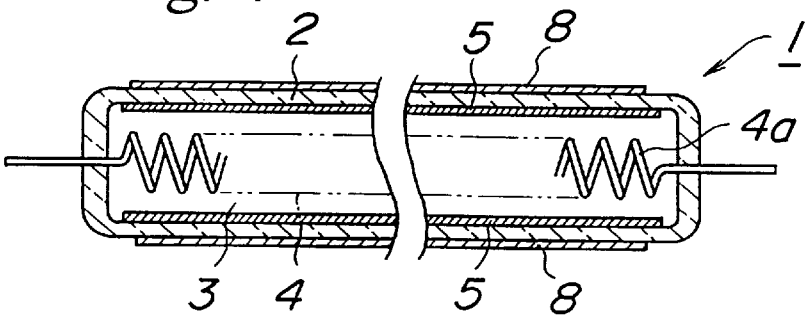
FIG. 4 is a cross section of a principal part of a fluorescent lamp according to a third embodiment of the present invention.

Referring to FIG. 4, another embodiment of the present invention is shown. The present embodiment is constituted to obtain light from the entire surface of the tubular glass bulb 2, while the foregoing embodiments are constituted to obtain light from the openings 5*a* and 6*b* by forming the external electrode 6 of a metallic foil.

In this embodiment, an external electrode 8 may be formed of a transparent conductive film such as ITO (Indium Tin Oxide) in place of the metallic foil used in the foregoing embodiments, thereby allowing the openings 5*a* and 6*b* to be eliminated. The function and effects obtained by the present embodiment are the same as those by the foregoing embodiments besides the above-described point, therefore the detailed description is eliminated.

Figure 5:
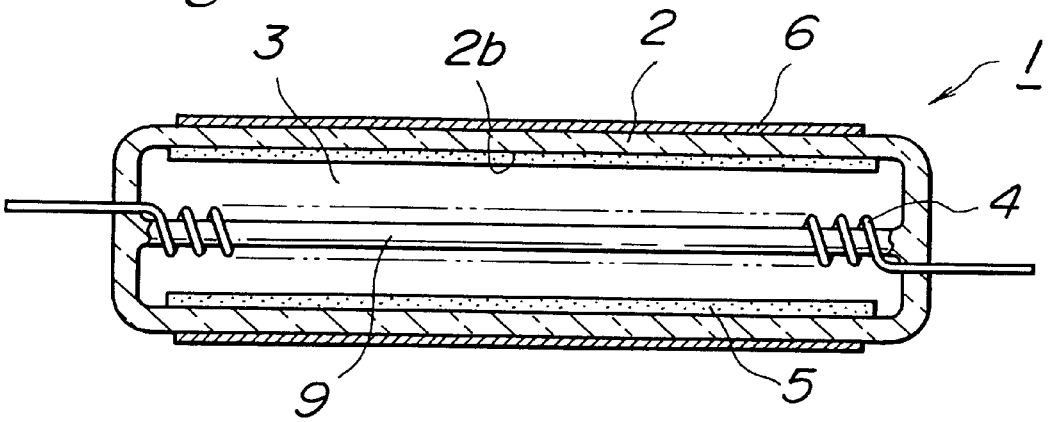
FIG. 5 is a cross section of a fluorescent lamp according to a fourth embodiment of the present invention.

Another embodiments of the present invention are now described in detail with reference to FIGS. 5 to 7. FIG. 5 shows a fluorescent lamp 1 according to a fourth embodiment of the present invention. In this fourth embodiment, both ends of the tubular glass bulb 2 are also sealed, forming the discharge chamber 3. The external electrode 6 is formed on the outer surface of the tubular glass bulb 2. The fluorescent layer 5 is formed on the inner surface of the tubular glass bulb 2. The coiled internal electrode 4 is provided at a position substantially along the central axis of the discharge chamber 3.

In this fourth embodiment, a resonance of the coiled internal electrode 4 caused by external oscillation is avoided by providing a pole 9. The pole 9 is made of a glass material with a coefficient of thermal expansion substantially equals to the tubular glass bulb 2.

The pole 9 with a cylindrical shape is formed at a position substantially along the central axis of the discharge chamber 3, both ends of which are connected to the tubular glass bulb 2. The outer diameter of the pole 9 is set at an appropriate dimension, for example, so as to have room against the inner surface of the internal electrode 4 even at the minimum storage temperature of the fluorescent lamp 1, and the pole 9 is inserted into the coiled internal electrode 4.

The function and effects of the above-described fluorescent lamp 1 of the present invention is now explained. In the fluorescent lamp 1, the pole 9 is inserted into the coiled part of the internal electrode 4, therefore free oscillation of the internal electrode 4 due to a resonance is not caused because the internal electrode 4 is supported by the pole 9, even if the fluorescent lamp 1 is used for a light source for a vehicle equipment at a place where it is easily affected by an outside oscillation. Accordingly, it is possible to prevent the fluorescent layer 5 from being injured by the freely oscillating internal electrode 4.

Figure 6:
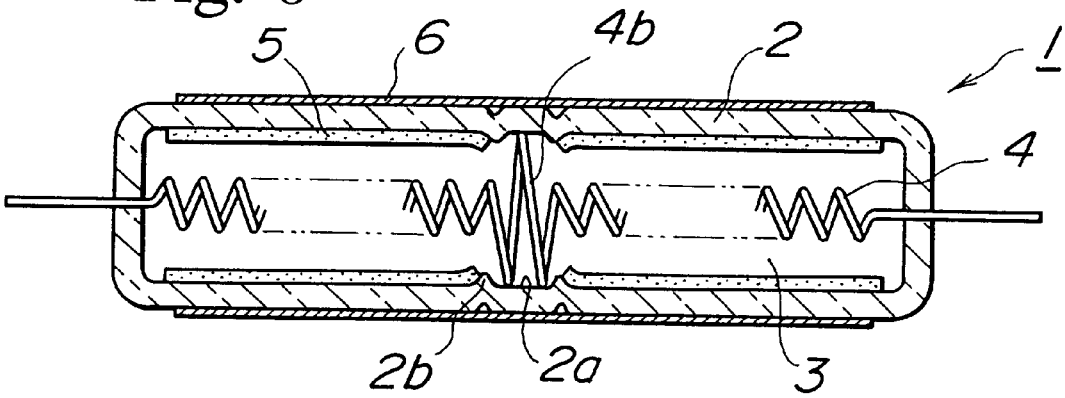
FIG. 6 is a cross section of a fluorescent lamp according to a fifth embodiment of the present invention.

Referring to FIG. 6, a fifth embodiment of the present invention is shown. While the internal electrode 4 is supported by the pole 9 at the inside of the coiled part in the fourth embodiment, in this fifth embodiment, the internal electrode 4 is supported by the inner surface of the tubular glass bulb 2 at the outside of the coiled part, which in turn unnecessitates the pole 9.

For this purpose, a support part 4*b* with a large coil diameter is provided at least one part of the internal electrode 4, the outer diameter of the support part 4*b* is set to be identical to or appropriately larger than the inner diameter of the tubular glass bulb 2. Optionally, the pitch of the support part 4*b* may be changed, when the coiled support part 4*b* is formed.

When the internal electrode 4 such formed is inserted into the tubular glass bulb 2, an appropriate tension is applied to the internal electrode 4 to deform it such that the outer diameter of the support part 4*b* is smaller than the inner diameter of the tubular glass bulb 2. Therefore, it is possible to easily insert the internal electrode 4 into the tubular glass bulb 2. Then, the tension is released when the internal electrode 4 is inserted and attains at the predetermined position, the outer diameter of the support part 4*b* returns to the original diameter. Therefore, it is possible to securely hold the internal electrode 4, because the support part 4*b* of the internal electrode 4 touches the inner wall 2*a* of the tubular glass bulb 2.

In this fifth embodiment, as described above, the support part 4*b* of the internal electrode 4 touches the inner wall 2*a* of the tubular glass bulb 2. Therefore, if the fluorescent layer 5 is provided on the inner wall 2*a*, it is thought that the fluorescent layer 5 is damaged by the touch of the support part 4*b*. Accordingly, it is preferable that a part of the fluorescent layer 5 that is estimated to be touched by the support part 4*b* is eliminated. The partial elimination of the fluorescent layer 5 is not essential. That is not required, for example, in the case that the fluorescent lamp 1 is not directly observed.

When the fluorescent lamp 1 is used in an apparatus, for example, to which a remarkably large vibration is applied from outside, a vibration isolation may be much increased by providing projecting parts 2*b* at positions on the tubular glass bulb 2 corresponding to both sides of support part 4*b* of the internal electrode 4, as shown in FIG. 6, to prevent the support part 4*b* from moving in the axial direction.

In this fluorescent lamp 1 of the fifth embodiment, the support of the internal electrode 4 is realized by utilizing the tubular glass bulb 2 which is the essential constructive member of the lamp 1. Therefore, it is possible to support the internal electrode 4 without preparing another support member such as the pole 9 in the fourth embodiment, or without increasing the number of parts.

Figure 7:
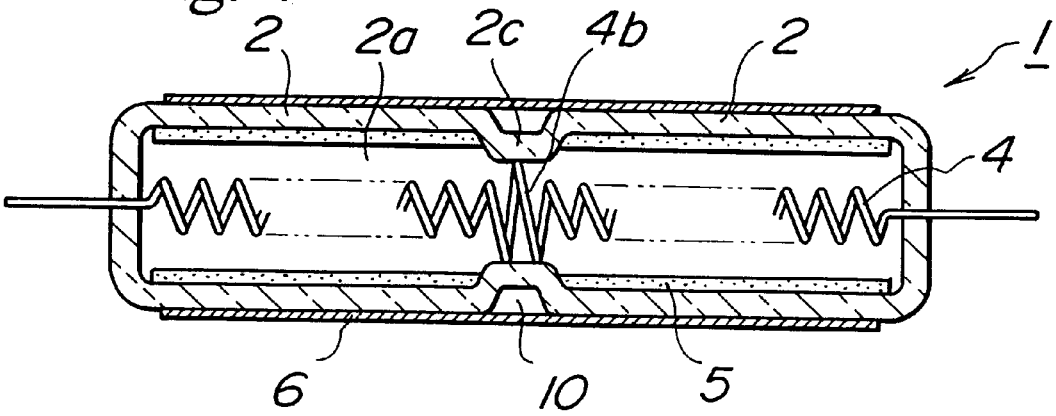
FIG. 7 is a cross section of a fluorescent lamp according to a sixth embodiment of the present invention.

Referring to FIG. 7, a sixth embodiment of the present invention is shown. In the fifth embodiment, the outer diameter of the support part 4*b* provided in the internal electrode 4 is set to be substantially identical to the inner diameter of the tubular glass bulb 2, causing the distance between the external electrode 6 and the support part 4*b* to be close, which may increase a tendency for the discharge current to be concentrated on the support part 4*b*. Therefore, there is a possibility that luminance nonuniformity or the like happens.

This sixth embodiment is intended to solve the above problem. In this embodiment, a restricted part 2*c* with a reduced outer and inner diameter is provided at an appropriate part of the tubular glass bulb 2 and the diameter of the support part 4*b* provided in the internal electrode 4 is set to be substantially identical to the inner diameter of the restricted part 2*c*.

In addition, the diameter of the external electrode 6 provided on the outer surface of the tubular glass bulb 2 is set to be substantially identical to the standard diameter of the bulb 2 or the diameter at the part where the restricted part 2*c* is not provided. Therefore, a gap 10 is formed at the position corresponding to the restricted part 2*c*. Optionally, in this sixth embodiment, the fluorescent layer 5 at the inner surface of the tubular glass bulb 2 corresponding to the restricted part 2*c* which contacts with the support part 4*b* also may be eliminated.

In this sixth embodiment, when a voltage is applied for lighting the lamp 1, the discharge is performed through the gap 10 where the air exists at the position corresponding to the restricted part 2*c*. Therefore, the increase in the discharge voltage due to the existence of the gap 10 happens at the position corresponding to the restricted part 2*c*, easing the degree of a current concentration at the restricted part 2*c*.

Figure 8A:
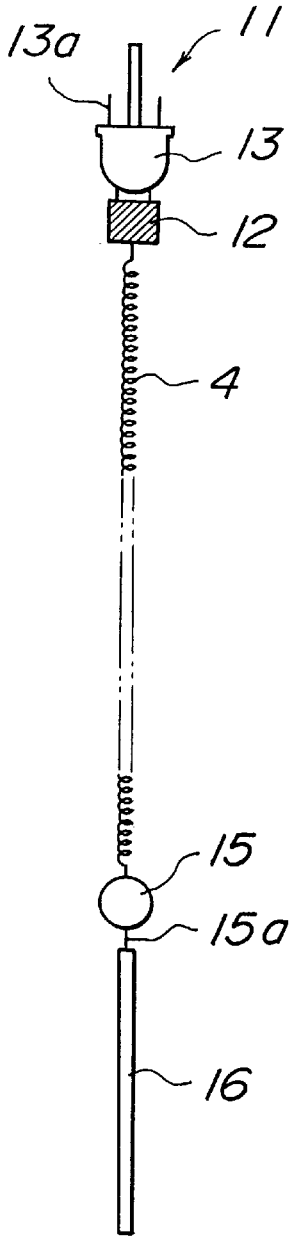
FIGS. 8A to 8C are views explaining an embodiment of a method for manufacturing a fluorescent lamp according to the present invention shown in order of process.
Figure 8B:
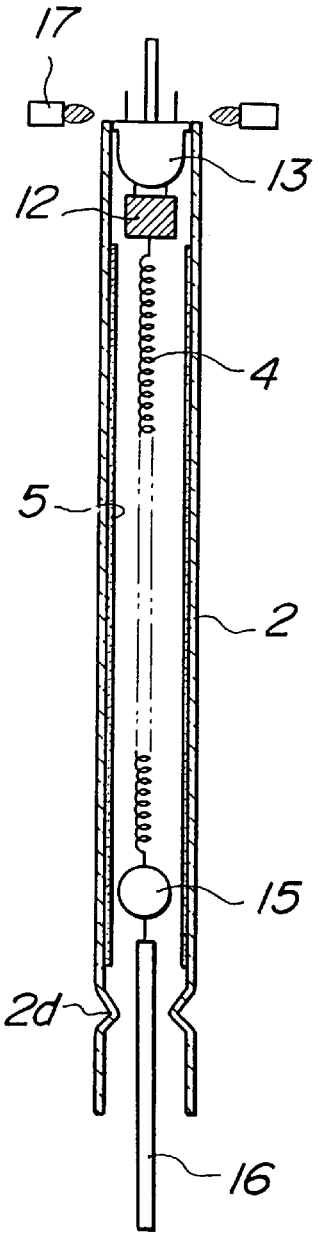
Figure 8C:
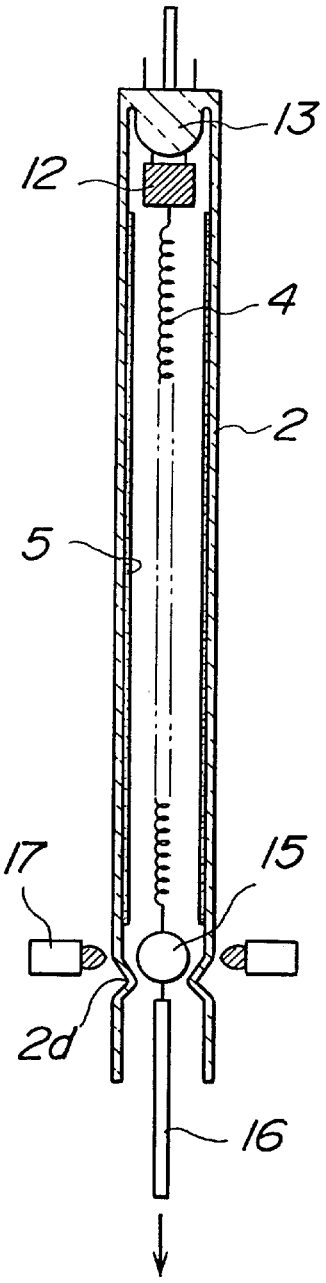

A manufacturing method of the fluorescent lamp 1 according to the present invention is next described. FIGS. 8A to 8C are drawings for showing the processes, wherein FIG. 8A shows a process for forming a mount 11. In this process, as well as the prior art, one end of the coiled internal electrode 4 is connected, by spot welding or the like, to a stem 13 to which a getter 12 is attached.

In the present invention, a bead stem 15 is connected to the other end of the internal electrode 4 by the spot welding or the like. In detail, the internal electrode 4 is connected to the inner ends of lead-in wires 13*a* and 15*a* passing through the stem 13 and the bead stem 15 as the other stem, respectively.

In the present invention, a type of the stem 13 is not limited, any shape of stem such as a flare stem, a button stem or a bead stem employed as the other stem can be used for the stem 13. However, the type of the stem 15 is limited only to the bead stem.

Furthermore, in the present invention, a weight 16 is connected to the outer end of the lead-in wire 15*a* passing through the bead stem 15, in addition to the connection of the bead stem 15. The weight 16 is formed of a metal such as nickel into a stick shape, and attached, by the spot welding or the like, to the wire 15*a* on the extended line of the wire 15*a* so as to form a straight line with the wire 15*a*.

Referring to FIG. 8B, the insert process of the mount 11 into the tubular glass bulb 2 and the welding process of one end of the tubular glass bulb 2 are shown. When the mount 11 constructed above is freely hold such that the stem 13 is at the upper side, the internal electrode 4 is vertically hung by gravitation because the weight 16 is attached to the internal electrode 4. Therefore, if the mount 11 constructed above is inserted into the tubular glass bulb 2 which is hold such that the axial direction of the bulb 2 is the vertical direction, the internal electrode 4 is arranged at the position substantially along the central axis of the tubular glass bulb 2 because both the bulb 2 and the internal electrode 4 are in the vertical direction. Further, the weight 16 protrudes from the lower end of the tubular glass bulb 2.

Since the bead stem 15 has been previously attached to the internal electrode 4, an operation such as a location determination can be performed by handling the weight 16 protruding from the lower end of the tubular glass bulb 2. Therefore, it is not necessary for the stem 13 to be inserted lower than a predetermined attachment position at the upper end of the tubular glass bulb 2, which allows the stem 13 and the tubular glass bulb 2 to be immediately welded by a burner 17 when the stem attains the predetermined position.

When the mount 11 is inserted into the tubular glass bulb 2, the mount 11 can be smoothly inserted without a catch on the way even if the bead stem 15 and the weight 16 have already attached, because the outer diameter of the bead stem 15 and the weight 16 are sufficiently small compared to the inner diameter of the tubular glass bulb 2.

The bead stem 15 and the weight 16 do not touch the fluorescent layer 5 formed on the inner surface of the bulb 2 on the way of the insert. Even if they touch the fluorescent layer 5, it is not injured because the bead stem 15 does not have a convex part with an acute angle.

Referring to FIG. 8C, the welding process of the bead stem to the tubular glass bulb 2 is shown. After the stem 13 is welded, the bead stem 15 is made to touch a restricted part 2*d* provided at a predetermined attachment position in the tubular glass bulb 2, for example, by pulling the weight. Thereafter, the tubular glass bulb 2 and the bead stem 15 are welded in this state. Since they are welded in such state that the internal electrode 4 is pulled, the coiled internal electrode 4 is laid with a predetermined tension.

Figure 9:
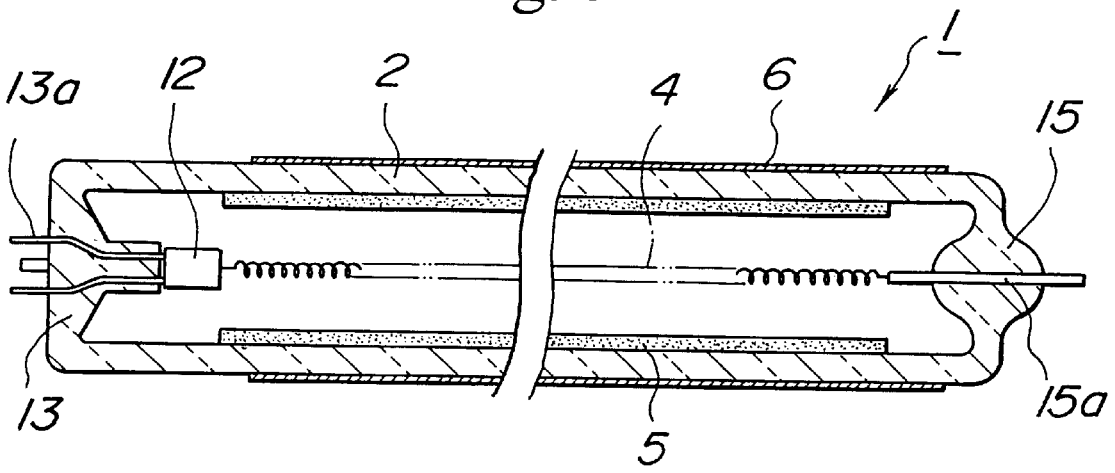
FIG. 9 is a cross section of a fluorescent lamp obtained by the method.
Figure 10:
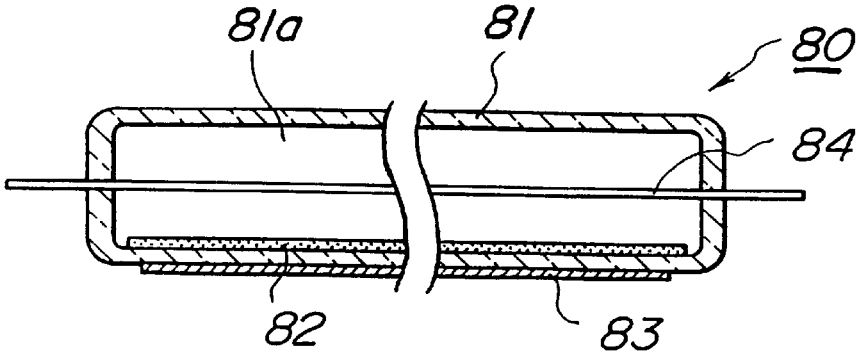
Fig. 10 Prior Art
FIG. 10 is a cross section of a conventional fluorescent lamp.
Figure 11:
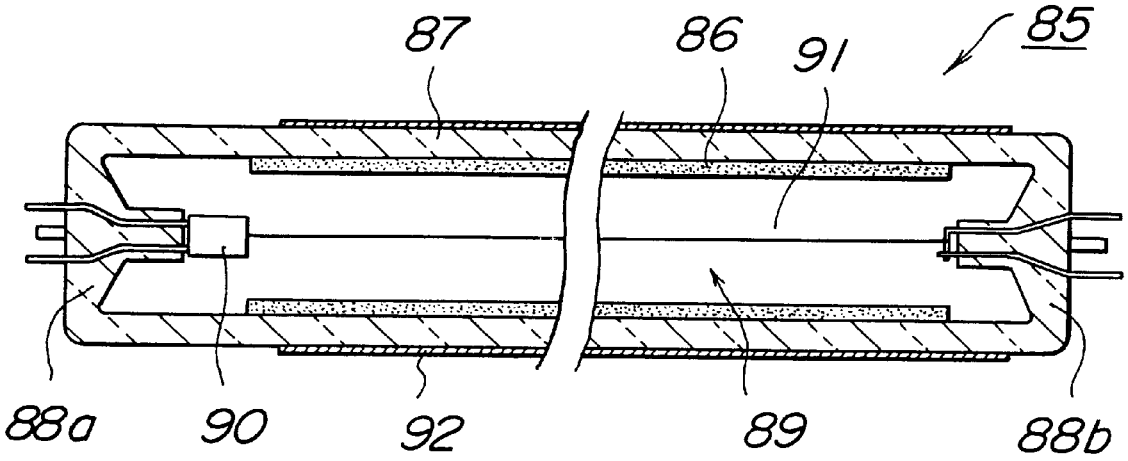
Fig. 11 Prior Art
FIG. 11 is a cross section of another conventional fluorescent lamp.
Figure 12D:
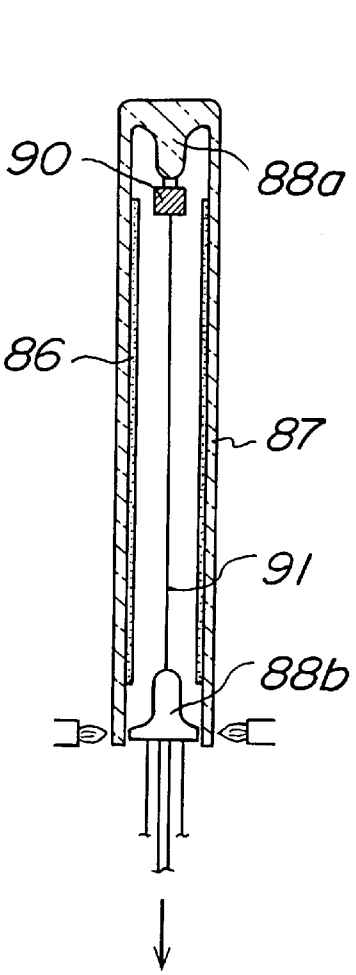
Fig. 12D Prior Art
FIGS. 12A to 12D are views explaining a conventional method for manufacturing a fluorescent lamp.
Figure 12C:
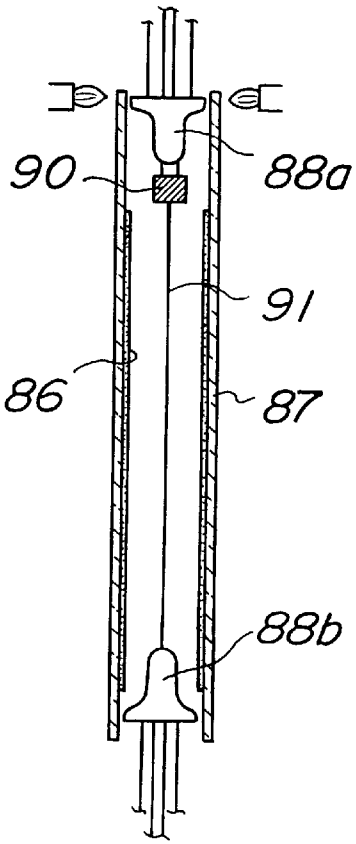
Fig. 12C Prior Art
Figure 12B:
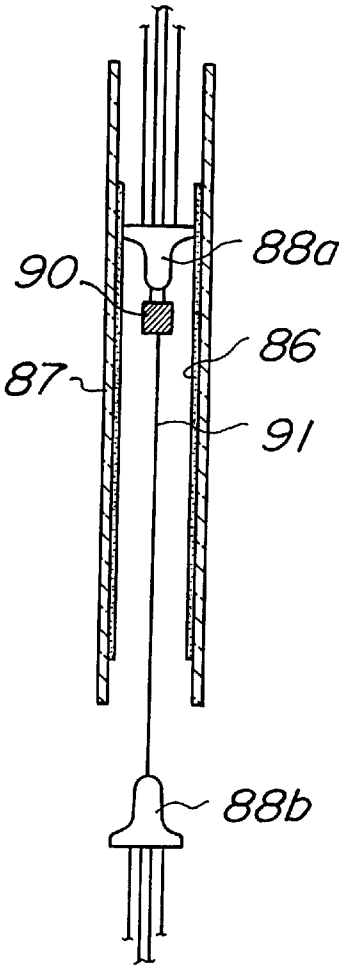
Fig. 12B Prior Art
Figure 12A:
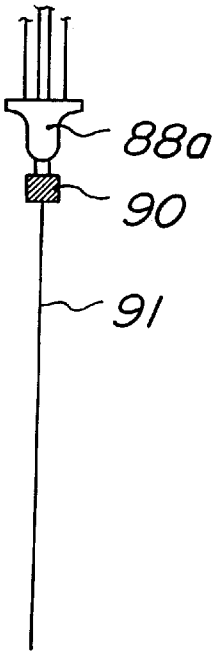
Fig. 12A Prior Art

Then, the weight 16 and an unnecessary part of the tubular glass bulb 2 are eliminated, thereafter discharging the air, filling rare gas, sealing, and constructing the external electrode 6 are sequentially performed, allowing the fluorescent lamp 1 of the present invention shown in FIG. 9 to be obtained. Therefore, according to the manufacturing method of the present invention, it is possible to prevent the fluorescent layer 5 of the fluorescent lamp 1 obtained from being wounded, as well as simplifying the manufacturing process.

EFFECTS OF THE INVENTION

As described above, according to the present invention, in which an internal electrode is formed in a coiled shape and laid in a tubular glass bulb with a tension, it is possible, even if there is a difference in coefficient of thermal expansion between the tubular glass bulb and a metallic member forming the internal electrode, to prevent a sag in the internal electrode from occurring when a temperature changes due to the difference and to prevent either the tubular glass bulb or the internal electrode from being broken because of an excessive stress, thereby overcoming the first problem concerning such type of fluorescent lamp.

The internal electrode is made to have an appropriate resistance characteristic, because the diameter $\phi$ of the internal electrode is associated with the lighting current A of the fluorescent lamp so as to satisfy a condition $\phi \leqq kA$, where k is a proportionality constant such that in the examle where A is in A units and $\phi$ is in mm, k=1. Therefore, it is possible, even if there is a part with a low discharge resistance, to prevent an excess current from being concentrated on the part due to the resistance characteristic of the internal electrode, which in turn prevents the internal electrode and/or the external electrode from being exhausted, thereby overcoming the second problem concerning such type of fluorescent lamp.

Furthermore, it is possible to perform the discharge with the same condition with regard to all the discharge path from the internal electrode to the external electrode, because the entire part of the external electrode is made to be concealed by the fluorescent layer when observed from the internal electrode, which in turn prevents the discharge from being concentrated, thereby overcoming the third problem that a hole is formed in the tubular glass bulb, which is easy to occur with such type of fluorescent lamp.

In addition, since the external electrode is made of a metallic foil with a bright surface such as a mirror surface, light emitted from the fluorescent layer is reflected toward the inner direction of the tubular glass bulb to be converged. Therefore, it is possible to increase an apparent luminous efficiency by causing substantially all of reflected light to be irradiated from an opening. Accordingly, the fourth problem that such type of fluorescent lamp has a relatively low efficiency is overcome, thereby obtaining the extremely excellent effect for increasing a utility and a reliability of such type of fluorescent lamp.

Moreover, since the fluorescent lamp has the coiled internal electrode supported by a glass member at the inside or the outside thereof, it is possible to prevent the coiled internal electrode in a resonance state from touching the fluorescent layer, or to eliminate a factor for occurring a wound in the fluorescent layer, thereby obtaining the extremely excellent effect for increasing a durability and a use of such type of fluorescent lamp.

According to the manufacturing method of the present invention, a mount has at least one bead stem, a coiled internal electrode being attached between lead-in wires in advance, a metal stick weight being attached to the outer end of the lead-in wire on the bead stem side so as to form a straight line with the lead-in wire on the bead stem side, the upper stem in a state that the mount is hung downward in the tubular glass bulb such that the bead stem and the weight orients are at the lower side being welded, an appropriate tension being applied to the internal electrode by handling the weight, and the bead stem being welded in this state.

Therefore, first, since the bead stem with a small outer diameter compared to another type of stem is employed, it is possible to easily attach the stem to the tubular glass bulb if the stem is previously attached to both ends of the internal electrode when the mount is manufactured, causing the complicated process such that one stem is attached to the internal electrode after the other stem is attached to the tubular glass bulb to be unnecessary, thereby obtaining the extremely excellent effect for increasing a productivity of such type of fluorescent lamp.

Second, since the outer diameter of the bead stem and the weight has sufficiently small diameter compared to the inner diameter of the tubular glass bulb, the bead stem and the weight do not touch the fluorescent layer formed on the inner surface of the bulb on the way of the insert, even if they touch the fluorescent layer it is not injured because the bead stem does not have a convex part with an acute angle, thereby obtaining the extremely excellent effect for increasing a quality of the fluorescent lamp manufactured by the present invention.

While there has been described what are at present considered to be preferred embodiments of the invention, it will be understood that the present invention is not limited thereto, and various modifications may be made by those skilled in the art without departing from the scope of the appended claims of the present invention.

What is claimed is:

1. A fluorescent lamp comprising a tubular glass bulb forming a discharge chamber, an internal electrode provided substantially along the central axis of the tubular glass bulb so as to pass through the tubular glass bulb, a fluorescent layer provided on the inner surface of the tubular glass bulb, and an external electrode provided on the outer surface of the tubular glass bulb, wherein the internal electrode, at least a part of which has a coiled shape, is laid in the tubular glass bulb with a predetermined tension.

2. A fluorescent lamp according to claim 1, wherein each of the fluorescent layer and the external electrode has an opening like a slit axially elongated along the tubular glass bulb such that the fluorescent layer conceals both edges of the opening of the external electrode when observed from the internal electrode.

3. A fluorescent lamp according to claim 2, wherein the internal electrode is made of a getter material.

4. A fluorescent lamp according to claim 3, wherein the diameter $\phi$ of the internal electrode and the lighting current A of the fluorescent lamp satisfies an inequality $\phi \leqq kA$, where k is a proportionality constant, such that where A is in A units and $\phi$ is in mm units, k=1.

5. A fluorescent lamp according to claim 3, wherein the external electrode is a metallic foil with a bright surface, and is attached to a predetermined position on the outer surface of the tubular glass bulb by a transparent heat shrink tube.

6. A fluorescent lamp according to claim 2, wherein the diameter $\phi$ of the internal electrode and the lighting current A of the fluorescent lamp satisfies an inequality $\phi \leqq kA$, where k is a proportionality constant, such that where A is in A units and $\phi$ is in mm units, k=1.

7. A fluorescent lamp according to claim 6, wherein the external electrode is a metallic foil with a bright surface, and is attached to a predetermined position on the outer surface of the tubular glass bulb by a transparent heat shrink tube.

8. A fluorescent lamp according to claim 1, wherein the internal electrode is made of a getter material.

9. A fluorescent lamp according to claim 8, wherein the diameter $\phi$ of the internal electrode and the lighting current A of the fluorescent lamp satisfies an inequality $\phi \leqq kA$, where k is a proportionality constant, such that where A is in A units and $\phi$ is in mm units, k=1.

10. A fluorescent lamp according to claim 8, wherein the external electrode is a metallic foil with a bright surface, and is attached to a predetermined position on the outer surface of the tubular glass bulb by a transparent heat shrink tube.

11. A fluorescent lamp according to claim 1, wherein the diameter $\phi$ of the internal electrode and the lighting current A of the fluorescent lamp satisfies an inequality $\phi \leqq kA$, where k is a proportionality constant, such that where A is in A units and $\phi$ is in mm units, k=1.

12. A fluorescent lamp according to claim 11, wherein the external electrode is a metallic foil with a bright surface, and is attached to a predetermined position on the outer surface of the tubular glass bulb by a transparent heat shrink tube.

13. A fluorescent lamp according to claim 1, wherein the external electrode is a metallic foil with a bright surface, and is attached to a predetermined position on the outer surface of the tubular glass bulb by a transparent heat shrink tube.

14. A fluorescent lamp according to claim 1, wherein the external electrode is a transparent conductive film.

15. A fluorescent lamp according to claim 1, wherein the internal electrode is supported by a glass member at the inside or the outside of the coiled part.

16. A fluorescent lamp according to claim 15, wherein the glass member is a pole substantially along the central axis of the tubular glass bulb, both ends of which being connected to the tubular glass bulb, and the internal electrode is supported by the pole at the inside of the coiled part.

17. A fluorescent lamp according to claim 15, wherein the glass member is the tubular glass bulb, a support part with a large coil diameter being provided at least one part of the internal electrode, the internal electrode being supported by touching the outside of the support part to the inside of the tubular glass bulb.

18. A fluorescent lamp according to claim 17, wherein the fluorescent layer is provided on the inner surface of the tubular glass bulb other than the inner surface of the tubular glass bulb touched by the support part of the internal electrode.

19. A fluorescent lamp according to claim 17, wherein a restricted part with a reduced diameter is provided at a part of the tubular glass bulb where the support part of the internal electrode touches, the inner diameter of the external electrode having a standard diameter of the tubular glass bulb, a gap between the inner surface of the external electrode and the outer surface of the restricted part being formed at the restricted part.

20. A fluorescent lamp, comprising:

a tubular glass bulb applied a fluorescent layer on the inner surface thereof;

a pair of stems welded to both ends of the tubular glass bulb, through which lead-in wires are passing;

an internal electrode laid between the lead-in wires to be located at the central axis of the tubular glass bulb; and an external electrode provided on the outer surface of the tubular glass bulb, wherein the internal electrode has a coiled shape, and at least one of the stems is a bead stem.

* * * * *